United States Patent [19]

Kinzl et al.

[11] 4,404,939

[45] Sep. 20, 1983

[54] ELECTRICAL CIRCUIT FOR ACTUATION OF THE RELAYS OF A FUEL PUMP

[75] Inventors: Marwin Kinzl, Kierspe; Eduard Bergmann, Luedenscheid, both of Fed. Rep. of Germany

[73] Assignee: Kostal of America, Ludenscheid, Fed. Rep. of Germany

[21] Appl. No.: 291,166

[22] Filed: Aug. 10, 1981

[30] Foreign Application Priority Data

Aug. 9, 1980 [DE] Fed. Rep. of Germany ..... 3030240

[51] Int. Cl.[3] ..... F02D 33/00

[52] U.S. Cl. ..... 123/333; 123/198 DB

[58] Field of Search ..... 123/198 D, 198 DB, 332, 123/333, 334, 335, 497, DIG. 11

[56] References Cited

U.S. PATENT DOCUMENTS

| | | | |
|---|---|---|---|
| 3,742,256 | 6/1973 | Frederiksen et al. | 123/497 X |
| 4,058,106 | 11/1977 | Drews et al. | 123/333 X |
| 4,311,124 | 1/1982 | Schulzke | 123/3233 |

*Primary Examiner*—Tony M. Argenbright

[57] ABSTRACT

An electrical circuit for controlling the operating of the relay of a fuel pump depending on the number of revolutions of the motor supplied by the fuel pump, whereby the fuel pump is cut off if the minimally permissible time interval being ignition pulses falls short, i.e., the number of revolutions of the motor exceeds an established value.

7 Claims, 2 Drawing Figures

ELECTRICAL CIRCUIT FOR ACTUATION OF THE RELAYS OF A FUEL PUMP

BACKGROUND OF THE INVENTION

The invention relates to an electrical circuit for controlling the operation of the relay of a fuel pump depending upon the number of revolutions of the motor supplied by the fuel pump.

The electrical circuit of the invention cuts off the fuel supply of a monitored motor, if a permissible maximum number of revolutions is exceeded. The invention is particularly adapted for use with automotive vehicles, however, it can be used with other monitored motors as well.

In accordance with the invention, an electrical circuit is provided which controls the operation of a relay that controls the operation of the fuel pump, and pulses analogous to the number of revolutions of the monitored motor are coupled to the electrical circuit. Those pulses are compared with a specified fixed comparison value which corresponds to the minimally permissible time between two ignition pulses. When the monitored motor is running, opening of the fuel pump relay circuit takes place only if the minimally permissible time between the ignition pulses falls short; and closing again takes place only in case of an at least slightly greater time interval between two ignition pulses.

A feature of the invention is that there is provided, in series with the fuel pump relay, the collector-emitter path of a transistor whose base is controlled by the output of a flip-flop. This flip-flop, in turn, has coupled to it both timing pulses from a pulse generator TD and the output of a Schmitt trigger, with the Schmitt trigger generating a constant signal at its output which corresponds to the smallest permissible pulse interval between two ignition pulses. The Schmitt trigger is set by the negative edge of each ignition pulse and remains for a fixed time. The output of the flip-flop is a "1" signal, as long as its input from the Schmitt trigger is a "1" signal and its input from the pulse generator is a "0" signal. The "1" signal from the flip-flop maintains the transistor conductive, and with the transistor conductive, the fuel pump relay is operated to energize the fuel pump. The output of the flip-flop is a "0" signal if both of its inputs are a "1" signal, and the transistor is rendered non-conductive cutting off the fuel pump relay and hence the fuel pump.

A further feature is the provision of another transistor which inverts by 180° the arriving ignition signal. The ignition signal normally has a relatively flat leading positive edge and a relatively steep-slope trailing negative edge, thus a second steep-slope leading edge is produced, since the previously negative steep-slope edge forms then a positive steep-slope edge. Moreover, the transistor blocks with a negative signal and thereby protects the following electronic system.

A still further and preferred feature is the fact that the frequency of the timing pulses from the pulse generator is halved by a flip-flop, and that the determination as to whether the permissible number of revolutions or interval between two timing pulses has been exceeded is carried out edge-controlled at the flip-flop.

Furthermore, the transistor which inverts the arriving ignition signal couples the inverted signal to the flip-flop, and the inverted output $\overline{Q}$ of the flip-flop is coupled back to its input. The Q output of the flip-flop controls both the input of another flip-flop and, by way of a capacitor which is a component of a differentiating element, controls the input of a Schmitt trigger whose discharging transistor controls the charging of the capacitor of a clock element. The halving of the pulse sequence by the flip-flop prevents the next ignition pulse from falling in the discharging phase or the capacitor of the clock element. By means of this circuit there is recognized that when the Q output of the first flip-flop is coupled to the other flip-flop, and the output of the Schmitt trigger is positive, the maximally permissible number of revolutions is exceeded.

Furthermore, it is advantageous that the minimally permissible interval between two pulses is formed by a monostable trigger stage with its clock element.

Moreover, there is intended that the determination takes place always after each second timing pulse on the pulse generator. Beyond that, it is advantageous that by a change of the clock element the circuit is usable for all motor types.

Still another feature is that between the output of the Schmitt trigger and the input of the flip-flop there is connected by way of a base series resistance the base of a transistor whose emitter is grounded and whose collector is put on operating voltage either by way of a resistor and a capacitor in series with it, or by way of resistor which is in parallel with the series connected resistor and capacitor. A connection between the capacitor and resistor which are in series is made to the setting input of the flip-flop. With motor speeds of $>0$ to $\leqq 100$ r/min., the arrangement is operative to couple a "0" signal potential to the setting input of the flip-flop, so that its dynamic inputs are effective. Furthermore, with this arrangement, the after-running time of the fuel pump (usually less than 1 s) is regulated after the ignition has been turned off. Also, the normalization of the flip-flop takes place by this arrangement.

Moreover, it is advantageous that the Q output of the flip-flop is coupled back to the input of the Schmitt trigger with interposition of a diode and of a resistor in series with it, to produce a hysteresis which is adjustable and can amount, for instance, to 100 rev/min. during which, after the fuel pump is turned off, the fuel pump cannot be turned on because the number of revolutions is too high. The transistor T3 is rendered conductive again, only if the maximum number of revolutions falls short by, for instance, 100 rev/min. Without hysteresis, the operation would be nearly continuous in connection with a maximum number of revolutions because constant turning on and turning off of the fuel pump would take place. However, the electrical circuit is functionally efficient also without hysteresis.

Still another feature consists in the fact that, by way of a decoupling diode and a base resistor, the base of the transistor can be put on a terminal on battery voltage over the ignition lock.

Accordingly, it is an object of the invention to provide an arrangement or electrical circuit for actuating the relay of a fuel pump depending upon the number of revolutions of the motor supplied by the fuel pump.

BRIEF DESCRIPTION OF THE DRAWINGS

The foregoing and other objects and features of the invention may be better understood by reference to the following detailed description taken in connection with the accompanying drawings, in which.

DESCRIPTION OF A PREFERRED EMBODIMENT

Figure 1:
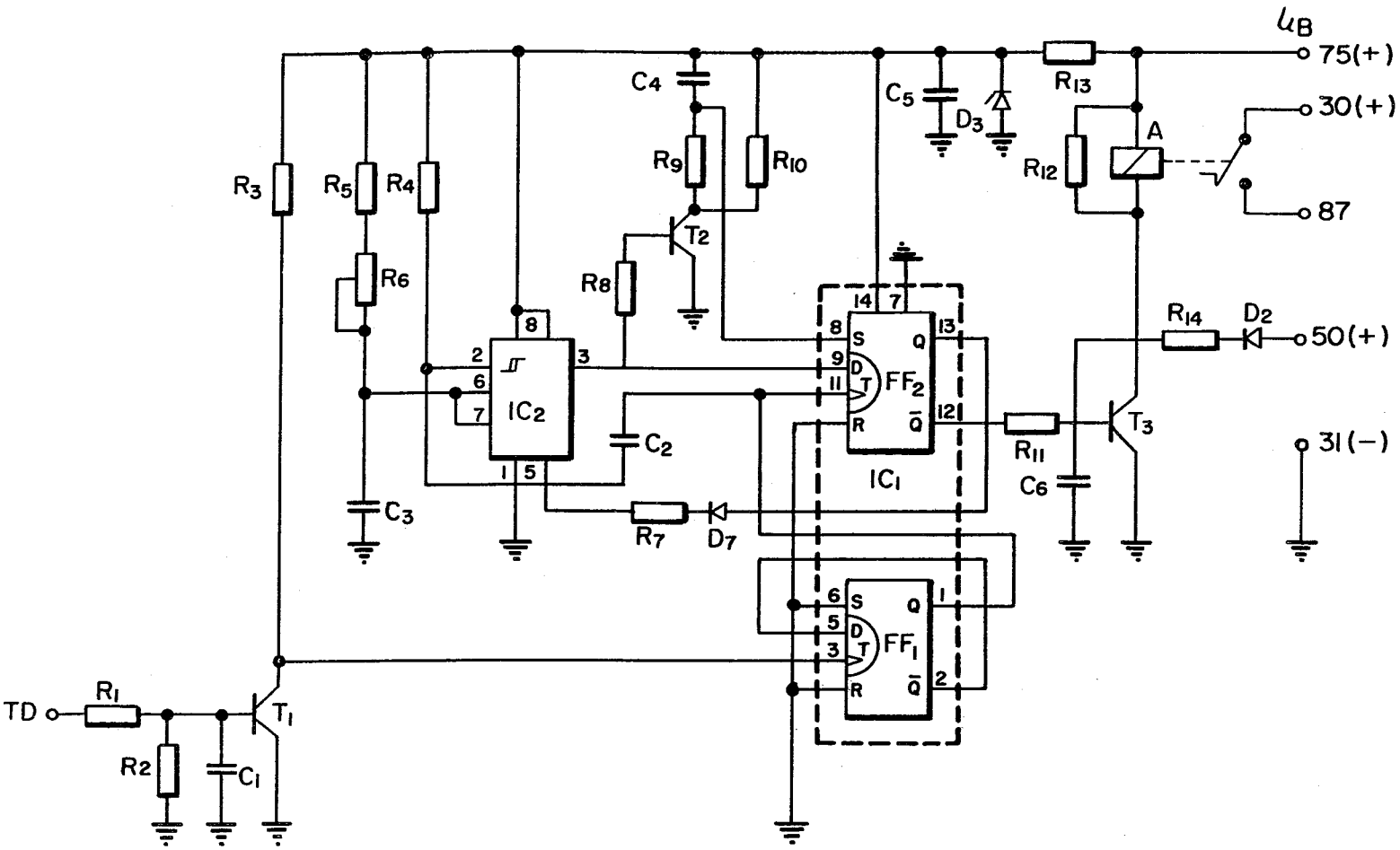
FIG. 1 is a schematic diagram of the electrical circuit of the invention.

Referring now to FIG. 1, there is illustrated an electrical circuit for controlling the operation of a relay A of a fuel pump (not shown) depending upon the number of revolutions of the motor supplied by the fuel pump. In FIG. 1, the positive battery terminal of a vehicle is indicated by the reference numeral 15, and its negative battery terminal is represented by the reference numeral 31. Positive battery voltage also is coupled to the terminal 30, and the fuel pump (not shown) is connected to the terminal 87. When relay A closes its contact, positive battery voltage is coupled to the fuel pump. The terminal 50, during the starting operation, has positive battery voltage coupled to it, by way of the ignition switch (not shown). Operating voltage is coupled from the terminal 15 to the relay A, and further to the collector of a transistor T3 whose emitter is grounded. A resistor R12 is connected in parallel with the relay A for protection thereof. The terminal 50 is connected to the base of the transistor T3 by way of a diode D2 and a resistor R14. The output 12 of a flip-flop FF2 also is coupled by way of a resistor R11 to the base of the transistor T2 for controlling its operation. In order to suppress interference pulses, a capacitor C6 is connected between the base of transistor T3 and ground. The stabilization of the operating voltage at terminal 15 with reference to vehicle ground (terminal 31) is provided by a resistor R13 and a Zener diode D3. Interference voltages from the onboard network are suppressed by a capacitor C5.

A flip-flop FF1 has its clock input 3 coupled by way of a resistor R3 to the terminal 15 (operating voltage). The resistor R3 also serves as the collector resistance for a transistor T1. The clock input 3 is also coupled to the collector of transistor T1. The emitter of transistor T1 is grounded, and its base is coupled by a base series resistor R1 to a pulse generator TD (not shown) but may be any pulse generator capable of generating pulses corresponding to the number of revolutions of the motor of the vehicle. A voltage divider network including the resistors R1 and R2 and a filter capacitator C1 is interposed between the pulse generator TD and the base to the transistor T1.

The $\overline{Q}$ output 2 (inverted signal) of the flip-flop FF1 is coupled to and controls its D input 5. The inputs S and R which comprise the setting and resetting inputs, respectively, of the flip-flop FF1 are grounded. The Q output 1 of the flip-flop FF1 is coupled to and controls the clock input 11 of another flip-flop FF2, and is also coupled by a capacitor C2 of a differentiating network including a resistor R4 and the capacitor C2 to the input 2 of a Schmitt trigger IC2. The resistor R4 of the differentiating network is coupled between input 2 of the Schmitt trigger IC2 and terminal 15 (operating voltage).

The input 14 of the flip-flop FF2 is coupled to terminal 15 (operating voltage), and its input 7 and R are grounded. The Q output 13 of the flip-flop FF2 is coupled to the input 5 of the Schmitt trigger IC2 by way of a diode D1 and a resistor R7. The D input 9 of the flip-flop FF2 is controlled by the output 3 of the Schmitt trigger IC2. The output 3 of the Schmitt trigger IC2, by way of a base series resistor R8, also is coupled to and controls the base of a transistor T2 whose emitter is grounded and whose collector is coupled to terminal 15 (operating voltage) by way of both resistor R9 and capacitor C4 which are in series with it and by way of a resistor R10. The setting input 8 of the flip-flop FF2 is coupled between the capacitor C4 and the resistor R9. The inputs 4 and 8 of the Schmitt trigger IC2 are on + operating voltage, and its input 1 is grounded. Its output 7 (internal discharging transistor) controls a clock including resistors R5 and R6 and capacitor C3 in series between + operating voltage and ground. The resistor R6 is an adjustable resistor. The input 6 of the Schmitt trigger IC2 is coupled between the resistor R6 and the capacitor C3.

Now that the construction of the electrical circuit has been described, its operation can be described as follows.

When the ignition of the automotive vehicle is turned on, the operating voltage on terminal 15 is stabilized by the resistor R13 and the Zener diode D3. The capacitor C5 protects the after-connected electronic system against interference voltages from the on-board network of the automotive vehicle. The output 3 of the Schmitt trigger IC2 is "0" when the ignition is turned on, and the transistor T2 remains blocked. The stabilized operating voltage is coupled through the resistors R10 and R9 which are in parallel with the capacitor C4 to the setting input 8 of the D flip-flop FF2, and its $\overline{Q}$ output 12 goes to "0". With the $\overline{Q}$ output 12 of the D flip-flop FF2 at "0", the transistor T3 is non-conductive, and the relay A is not energized. The fuel pump, which is connected to the terminal 87, remains turned off. The static condition of the outputs 1 and 2 of the D flip-flop FF1 is not important.

Figure 2:
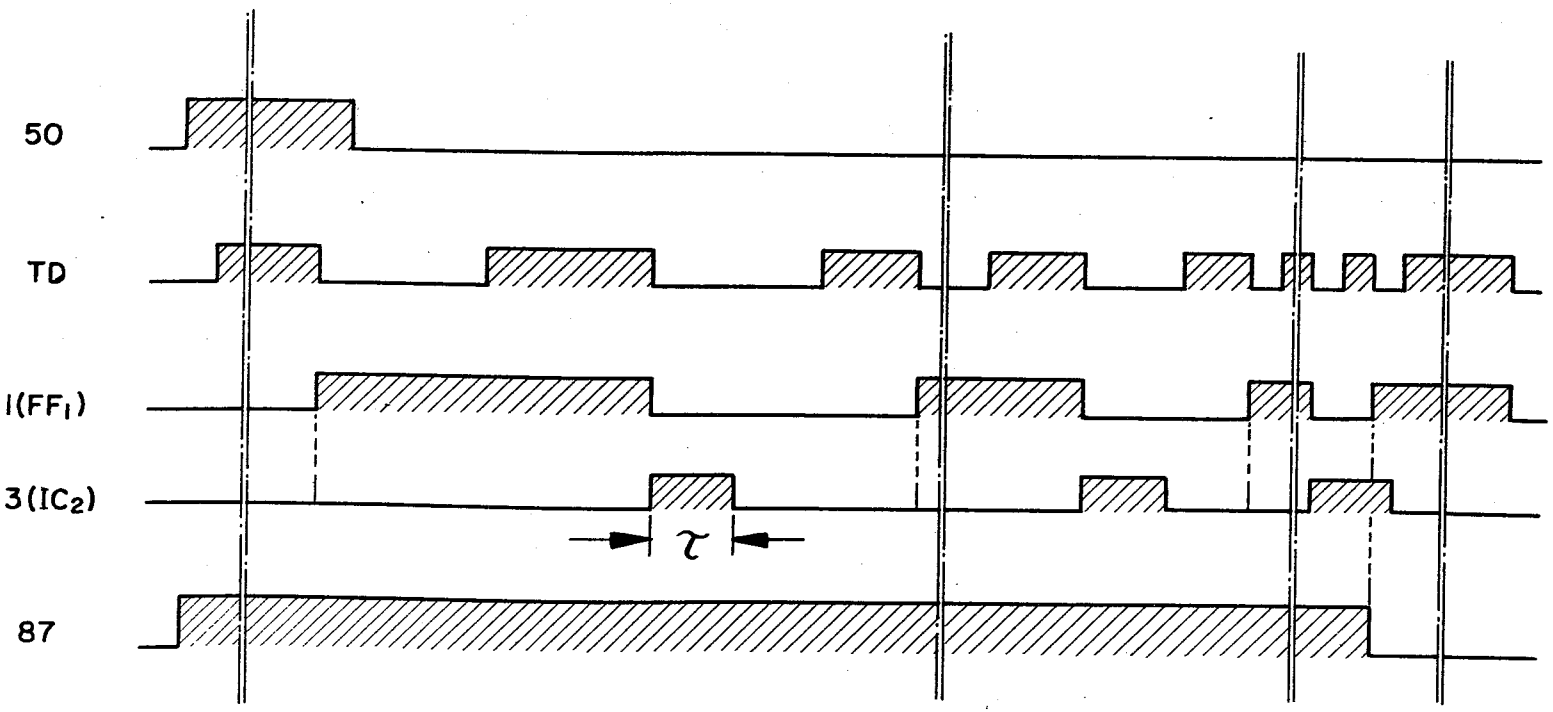
FIG. 2 is a pulse chart and timing diagram.

Now, with the starting operation, battery voltage is coupled to the terminal 50, as illustrated in FIG. 2, and is coupled by way of diode D2 and resistor R14 to the base of transistor T3 rendering it conductive. With transistor T3 conductive, relay A is energized and the fuel pump is turned on. The pulse generator TD, as can be seen in FIG. 2, couples timing pulses to the base of the transistor T1 by way of the voltage divider R1, R2. The timing pulses, which are in the filter screen of the ignition pulses (the duty factor proportion of this timing is practically without any importance), are inverted by the transistor T1, and these inverted timing pulses are coupled to the clock input 3 of the D flip-flop FF1. The output 2 of the D flip-flop FF1 is coupled back to its input 5, and the D flip-flop FF1 therefore sweeps with each positive edge and a timing signal with half the frequency of pulse generator TD is provided on its Q output 1. The duty factor proportion of this signal is 1:1. In FIG. 2, these timing signals are designated 1(FF1).

With each negative edge of the signal on the output 1 of D flip-flop FF1, a "0" signal is coupled by way of capacitor C2 for a short time to the trigger input 2 of Schmitt trigger IC2. The output 3 of the Schmitt trigger IC2 which is designated 3(IC2) in FIG. 2 changes now to a positive potential. Simultaneously, at its output 7, its internal discharging transistor discharges the charge of the capacitor C3 by way of resistors R6 and R5. The output 3 of the Schmitt trigger IC2 is switched to "0" again only when the voltage has reached $\frac{2}{3}$ of the operating voltage. The capacitor C3 is discharged (internal discharging transistor) and kept grounded until the next trigger pulse. More particularly, if the input 2 of the Schmitt trigger IC2 is less than $\frac{1}{3}$ of the operating voltage, the output 3 changes from "0" to "1". If the input 2 is over $\frac{2}{3}$ of the operating voltage, the output 3 changes from "1" to "0". The time designated T in FIG.

2 during which the output 3 of the Schmitt trigger IC2 is a "1" is equal to the minimally permissible time between two ignition pulses (maximally permissible motor speed).

The transistor T2 becomes conducting with each "1" signal on the output 3 of the Schmitt trigger IC2. When transistor T2 is conductive, the capacitor C4 is charged with respect to ground, by way of resistor R9. The circuit including C4, R9, T2 or C4, R9, R10 is tuned in such a way that, with motor speeds of $>0$ to $\leqq 100$ revolutions/min., a "0" potential is on the setting input 8 of the FF2 and thus the dynamic inputs 9 and 11 of FF2 are effective. The output 1 of flip-flop FF1 is coupled to the clock input 11 of flip-flop FF2 and, with each positive edge of this signal, the signal coupled to the input 9 of flip-flop FF2 at that time is connected through to its Q output 13 or appears inverted at its $\overline{Q}$ output 12. If a "0" signal prevails at the input 9 of the flip-flop FF2 at the trigger moment, its $\overline{Q}$ output 12 becomes "1" and the transistor T3 remains conducting. With successful ignition, the starting operation can now be terminated, and the fuel pump remains turned on.

If the motor runs in the permissible range of the number of revolutions, the $\overline{Q}$ output 12 of the flip-flop FF2 does not change its state. With an increasing number of revolutions of the motor, the trigger moment (positive edge of the signal on the input 11 of the flip-flop FF2) moves closer and closer to the positive signal on the output 3 of IC2, as illustrated in FIG. 2. When the positive trigger edge meets the positive signal at the input 9 of FF2, its $\overline{Q}$ output 12 becomes "0" and the transistor T3 is rendered non-conductive and the fuel pump is turned off, as can be seen in FIG. 2, where the operation of the fuel pump is designated 87. In such a case, the motor has exceeded the permissible number of revolutions. The speed of the motor drops because of the lacking fuel supply. When the trigger signal again recognizes a "0" signal at the input 9 of the flip-flop FF2, the fuel pump is turned on again.

The coupling back of the Q output 13 of the flip-flop FF2 to the input 5 of the Schmitt trigger IC2 gives a small hysteresis to the $\frac{1}{3}$ operating voltage threshold whereby "fluttering" of the relay A in the range of the turn-off number of revolutions is avoided. The circuit works likewise without hysteresis.

The capacitor C6 in connection with the resistor R11 serves to suppress short-time error pulses which can appear because of interference voltages on the output 12 of the flip-flop FF2.

By a tuning of the timing circuit C3 and R5, R6, the electrical circuit can be used to control the fuel pump relay for all 4, 6, 8 cylinder motor types. This is true also for Diesel motors, however, in this case, the required signal on TD is derived from the tachometer or other devices. An accurate setting to the turn-off number of revolutions is provided by adjusting the trimming resistor R6. A shut-off of the fuel pump relay takes place also when the ignition is turned off.

In FIG. 2, the timing diagram represents the operation in a simplified manner.

The number "50" signifies the + operating voltage coupled from the ignition switch to the base of the transistor T3. The rise takes place after the beginning of the starting operation, with the drop taking place after the termination of the starting.

The indicia "TD" illustrates the pulse sequence or signals generated by the pulse generator. The first pulse (left) takes place later in time than the beginning of the starting operation. As soon as the motor has been started, a pulse sequence is obtained and as the number of revolutions of the motor increases, the pulse sequence increases (from left to right), as illustrated.

The indicia "1(FF1)" illustrates the signal at the output 1 of the flip-flop FF1. With each first negative edge of TD, the positive edge of output 1 of flip-flop FF1 is set, and with each second one it is set back which is a consequence of the coupling back for the purpose of a reduction of the clock number (proportion 1:2).

The indicia "3(IC2)" illustrates the output signal at output 3 of the Schmitt trigger IC2. This signal is set each time when the signal 1 (FF1) is set back. The time length "T" of the signal 3(IC2) corresponds to the pulse interval in connection with the maximum speed of the motor. If 1(FF1) is a "1" signal, while 3(IC2) still is a "1" signal, the $\overline{Q}$ output 12 of flip-flop FF2 goes to a "0" signal and transistor T3 blocks and the fuel pump is turned off, as shown by the representation of 87.

It will thus be seen that the objects set forth above, among those made apparent from the preceding description, are efficiently attained and certain changes may be made in the above construction. Accordingly, it is intended that all matter contained in the above description or shown in the accompanying drawings shall be interpreted as illustrative and not in a limiting sense.

Now that the invention has been described, what is claimed as new and desired to be secured by Letters Patent is:

1. An electrical circuit for controlling the operation of the relay of a fuel pump depending upon the number of revolutions of the motor supplied by the fuel pump, ignition pulses corresponding to the number of revolutions of the motor being coupled to said electrical circuit, said electrical circuit comprising: relay control means for energizing said relay, said relay being connected with an operating voltage and said relay control means comprising a transistor having its collector-emitter path connected in series with said relay, whereby said transistor upon being rendered conductive energizes said relay; timing means operated responsive to each of said ignition pulses for generating a timing signal having an interval corresponding to the minimally permissible time between two ignition pulses; and control means operated responsive to said ignition pulses and said timing signals for generating output signals to control said relay control means, said control means comprising a flip-flop having inputs to which said timing signals and said ignition pulses are coupled respectively and an output coupled to the base of said transistor, said control means being responsive when only a timing signal is coupled thereto to operate said relay control means to energize said relay to thereby operate said fuel pump, and being responsive to a timing signal and an ignition pulse being simultaneously coupled thereto to operate said relay control means to de-energize said relay to thereby cut off the operation of said fuel pump.

2. The electrical circuit of claim 1, further comprising clock means coupled to said timing means for establishing the interval of said timing signal, whereby the minimally permissible time interval between two ignition pulses can be varied.

3. The electrical circuit of claim 1, further comprising means for cutting in half the frequency of said ignition pulses, whereby said control means is operative to provide an output signal only after each two ignition pulses.

4. The electrical circuit of claim 1, wherein the output of said control means is coupled to said timing means so as to provide a hysteresis, whereby fluttering of said relay in the range of the turn off number of revolutions is avoided.

5. The electrical circuit of claim 1, wherein said timing means comprising a Schmitt trigger which is set by the negative edge of each ignition pulse to generate said timing signal.

6. The electrical circuit of claim 5, further comprising a second flip-flop having an input to which said ignition pulses are coupled, said flip-flop being operated to couple ignition pulses having half the frequency of said ignition pulses coupled to it to said control means.

7. The electrical circuit of claim 6, further comprising means for inverting said ignition pulses coupled to said second flip-flop, whereby a second steep-sloped leading edge is provided.

* * * * *